US005915716A

United States Patent [19]

Artus

[11] Patent Number: 5,915,716

[45] Date of Patent: Jun. 29, 1999

[54] VIBRATION-DAMPING DEVICE FOR BOARD FOR SLIDING ON SNOW

[75] Inventor: Jean-Pierre Artus, Le Fontanie, France

[73] Assignee: Skis Rossignol S.A., Voiron, France

[21] Appl. No.: 08/688,278

[22] Filed: Jul. 29, 1996

[30] Foreign Application Priority Data

Aug. 2, 1995 [FR] France ..... 95 09627

[51] Int. Cl.[6] ..... A63C 5/075

[52] U.S. Cl. ..... 280/602; 280/809

[58] Field of Search ..... 280/602, 607, 280/610, 617, 618, 636, 809

[56] References Cited

U.S. PATENT DOCUMENTS

| | | | |
|---|---|---|---|
| 4,974,867 | 12/1990 | Rullier et al. | 280/607 |
| 5,035,442 | 7/1991 | Arnsteiner | 280/602 |
| 5,417,448 | 5/1995 | Le Masson et al. | 280/602 |
| 5,441,296 | 8/1995 | Phelipon et al. | 280/602 |
| 5,447,322 | 9/1995 | Le Masson et al. | 280/602 |
| 5,465,994 | 11/1995 | Commier et al. | 280/602 |
| 5,573,264 | 11/1996 | Deville et al. | 280/602 |

FOREIGN PATENT DOCUMENTS

| | | |
|---|---|---|
| 0490044 | 6/1992 | European Pat. Off. . |
| 0 639 391 | 2/1995 | European Pat. Off. . |
| 2 643 431 | 8/1990 | France . |
| 2675392 | 10/1992 | France . |
| 2701215 | 8/1994 | France . |
| 2709974 | 3/1995 | France . |
| 2 713 499 | 6/1995 | France . |
| WO 88/01189 | 2/1988 | WIPO . |
| WO 93/08883 | 5/1993 | WIPO . |

*Primary Examiner*—J. J. Swann
*Assistant Examiner*—Michael Mar
*Attorney, Agent, or Firm*—Oliff & Berridge, PLC

[57] ABSTRACT

A sliding board includes a device of the "stress plate" type, having a layer of viscoelastic material covered by a stress plate with a high elasticity modulus, the layer of viscoelastic material being joined to one outer surface of the sliding board and to the stress plate. According to the invention, the stress plate has at least one strip-shaped area that is not joined to the board over part of the width and part of the length of the plate, the strip being elastically flexible and being connected to the board by its ends so that when the board flexes, it behaves like a leaf spring acting mechanically by buckling between its two ends connected to the board.

21 Claims, 6 Drawing Sheets

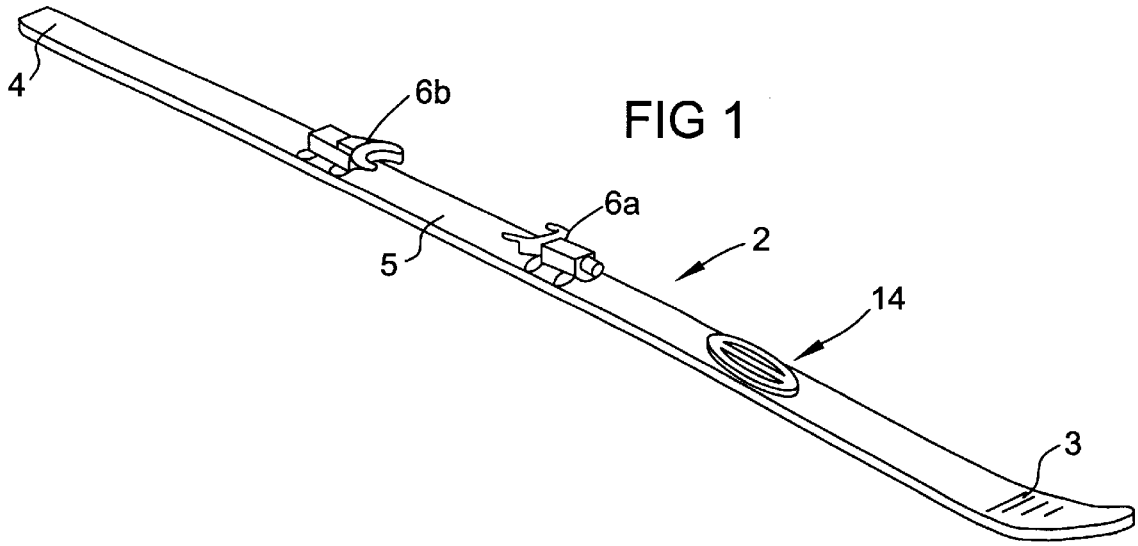
FIG 1
FIG 2
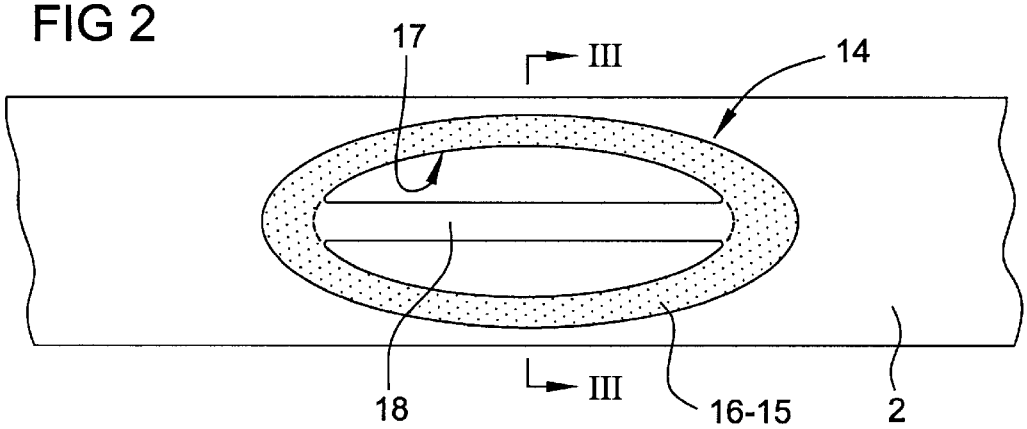
FIG 3
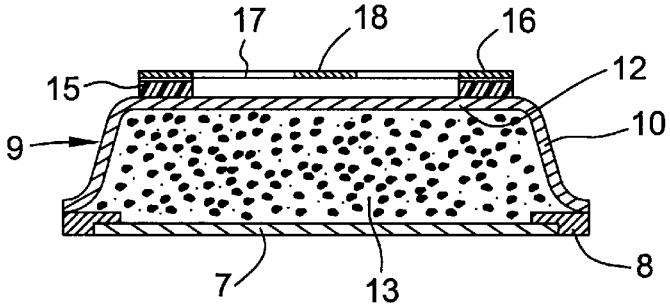
FIG 4
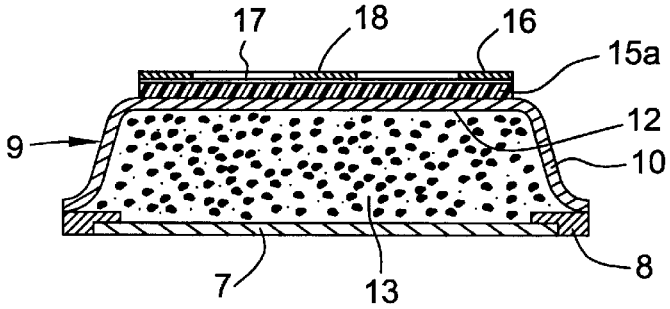

VIBRATION-DAMPING DEVICE FOR BOARD FOR SLIDING ON SNOW

BACKGROUND OF THE INVENTION

The present invention relates to a vibration-damping device for a board for sliding on snow, such as a ski, a monoski, or a snowboard.

It is known that parasitic vibrations of a board for sliding on snow can be damped to improve the comfort of the skier and the grip of the board on hard snow by providing, on the upper surface of the board, at least one stress plate device, namely including a layer of viscoelastic material attached to the upper surface of the board by gluing for example, the upper surface of this viscoelastic material layer itself being joined to a stress plate with a high elasticity modulus. When the board is flexed, a shear is produced between the layer of viscoelastic material located between the upper surface of the ski and the stress plate, which has the effect of damping vibrations. Depending on the type of board considered—ski designed for special slalom or ski designed for giant slalom—the parasitic frequencies to be damped are different, so that the location, size, and number of devices with which the board is equipped are different and matched to each case.

Document WO/01189 describes a ski, which, on its upper surface, has pressure elements disposed in front of and behind the binding area. These elements are made for example of elastic blades each of which is attached by one of its ends to the ski, and rests by the other end on the upper surface of the ski, or on an elastic stop associated therewith.

Document FR-A-2 675 392 relates to a ski having the same characteristics as those described in the foregoing document, with a flexible blade connected to the ski by a rigid link and by a flexible link, said links being spaced lengthwise from one another on the flexible blade.

Document EP-A-0 490 044 relates to a ski having a lower part or base as well as an upper part or stiffener. The link between the stiffener and base is provided by flexible or partially rigid means.

Document FR-A-2 701 215 relates to a ski whose upper surface is equipped with a flexible blade connected to the ski by at least two damping means spaced lengthwise on the ski with respect to each other.

Document FR-A-2 709 974, in the name of the Applicant, relates to a ski equipped with a plate for mounting the binding, said plate having a layer of viscoelastic material surmounted by a stress plate, said plate also having, in its mid-part, an area that is not joined to the ski and is deformed on the side opposite the ski, said plate undergoing, when the ski flexes, buckling between its ends which tend to return the ski to the straight, i.e. non-flexed position.

SUMMARY OF THE INVENTION

The goal of the invention is to provide a vibration-damping device for a board for sliding on snow, such as a ski, monoski, or snowboard, which is of the stress plate type, and wherein the stress plate offers other possibilities for damping or elastic return of the ski to its unstressed position.

For this purpose, the device to which it relates, which is of the "stress plate" type with any shape and whose largest dimension is oriented approximately lengthwise to the board, includes a layer of viscoelastic material covered by a stress plate with a high elasticity modulus, the layer of viscoelastic material being joined to one outer surface of the sliding board and to the stress plate, is characterized in that the stress plate has at least one strip-shaped area that is not joined to the board over part of the width and part of the length of the plate, said strip being elastically flexible and being connected to the board by its ends so that, when the board flexes, it behaves like a leaf spring acting mechanically by buckling between its two ends connected to the board, while the remainder of the device acts like a viscoelastic damper of the classical stress plate type.

It results from this design that the device provides the ski with a damping function by shearing of the layer of viscoelastic material as well as an elastic return function by the mechanical buckling effect of the strip not joined to the ski.

This strip which is not joined to the board can be an integral part of the stress plate, or made of a part separate therefrom and attached by its ends to the end areas of the stress plate which itself is attached to the ski. This attachment may be accomplished by an irreversible linking technique such as gluing, welding, or riveting, or by screwing, or by fitting the ends of the strip into openings provided in the end areas of the stress plate.

In each area that has a strip not joined to the board, viscoelastic material may or may not be provided. If there is a layer of viscoelastic material, the latter is attached to the upper surface of the board, and not attached to the strip. In order to favor mechanical buckling of the strip, this buckling can be preoriented upward by mechanical deformation of the strip, for example with the aid of an elastic stud mounted between the upper surface of the strip and the upper surface of the board, or by mechanical predeformation of the strip.

To favor the damping phenomenon, the central part of the strip may be fitted, on its surface facing away from the board, with a weight-spring system tuned to a certain frequency. This system may be composed of a cage containing a weight accommodated inside a viscoelastic substance.

The strip not joined to the board can be straight and oriented according to the lengthwise axis of the ski, or obliquely. This strip may occupy a central position relative to the plate, or be disposed laterally thereto.

The two end areas may be common to the strip not attached to the board, or the strip not attached to the board can have an end area joined to the board, but different from the rest of the plate.

According to another embodiment, the device includes several strips not attached to the board, disposed obliquely relative to the lengthwise axis thereof, and whose ends are joined to two lengthwise strips joined to the board over their entire surfaces.

According to another characteristic of the invention, a layer of viscoelastic material, on one surface of which a stress plate is mounted, is attached to the surface of the strip not joined to the board, facing away from the ski.

BRIEF DESCRIPTION OF THE DRAWINGS

In any event, the invention will be understood with the aid of the description hereinbelow with reference to the attached schematic drawings, which show several embodiments of this device as non-limiting examples and wherein:

FIG. 1 is a perspective view of a ski equipped with a first device;

FIG. 2 is top view on an enlarged scale of the part of the ski of FIG. 1 equipped with a vibration-damping device;

FIG. 3 is a view in cross section along line III—III in FIG. 2;

FIG. 4 is a cross-sectional view similar to FIG. 3 of a variant of the device of FIG. 3;

DESCRIPTION OF PREFERRED EMBODIMENTS

Figure 5:
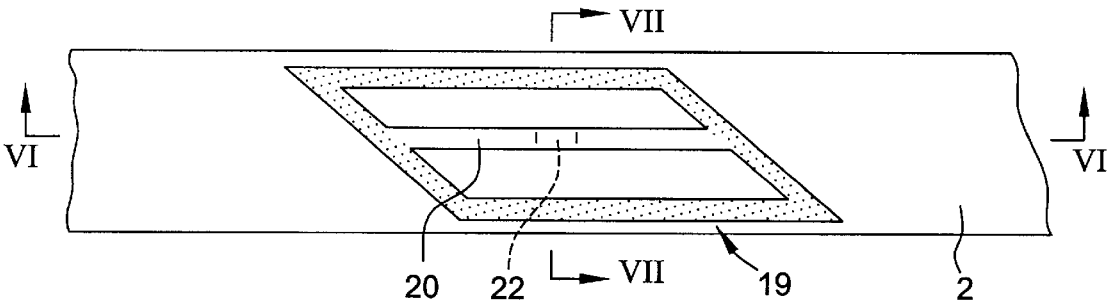
FIG. 5 is a top view of a second damping device mounted on a ski.

FIG. 1 shows a ski 2 having, in known fashion, a tip 3, a tail 4, and a mid-part or sliding area 5, in which a binding is mounted for a ski boot, composed of a toe unit 6*a* and a heel unit 6*b*. FIG. 3, as well as other figures, show this ski very schematically in cross section, it being specified that the structure of the ski is provided for illustrative purposes, but is not the subject of the invention. As shown in FIG. 3, the ski has a sliding bottom 7, bordered by two lengthwise metal edges 8 on which rest the lower edges of a shell 9, forming the side walls as well as the top wall 12 of the ski. The interior of this ski contains a core 13 and possibly reinforcing elements for both bottom 7 and shell 9, which are not shown. However, the invention may apply equally well to skis of traditional design, namely, those having lengthwise sides resting on edges 8, or on reinforcing elements associated with the edges, these sides themselves serving as supports for an upper wall made independently.

As shown in FIG. 1, a damping device 14 of the stress plate type, is disposed between toe unit 6 of the binding and tip 3. Although only one damping device is shown in the drawing, it is possible, depending on the type of behavior desired for the ski, and depending on the frequencies of the vibrations to be absorbed, according to whether it is a ski especially designed for giant slalom or for special slalom, to position the device 14 differently or to mount several devices 14.

In a known manner, a damping device with a stress plate has a layer 15 of viscoelastic material attached to upper wall 12 of the ski, by gluing for example. To this viscoelastic material layer is attached, also by gluing, a stress plate 16 with a high elasticity modulus. The vibrations are damped by a shearing phenomenon of viscoelastic material layer 15 between upper wall 12 of the ski and stress plate 16.

In the embodiment shown in FIG. 2, the damping device has a layer of viscoelastic material 15, as well as a stress plate 16 in the general shape of a hollow ellipse. The central part of the device has two openings 17, delimiting a straight lengthwise strip 18, which is not joined to the upper surface of the ski, it being specified that, as shown in FIGS. 2 and 3, there is no viscoelastic material layer either at openings 17, or under strip 18.

In FIG. 2, as in the other figures representing top views of other embodiments, the areas of the stress plate joined to the ski by gluing of the base of the viscoelastic material layer are shown as dotted areas, while strip 18, which is not joined to the ski, has no such dots.

Since strip 18 is elastically flexible and is attached by its ends to the board, since its ends rest on and are attached to viscoelastic material layer 15, it behaves like a leaf spring, acting mechanically by buckling between its two ends connected to the board. The remainder of the device acts like a viscoelastic damper of the stress plate type by shear of viscoelastic material layer 15 between upper wall 12 of the ski and stress plate 16.

FIG. 4 represents another embodiment of the device of FIGS. 1 to 3, in which the same elements are designated by the same numerals as above. In this embodiment, viscoelastic material layer 15*a* extends over the entire surface of the device, including openings 17, and under strip 18. However, strip 18 is not glued to viscoelastic material layer 15*a*.

Figure 6:
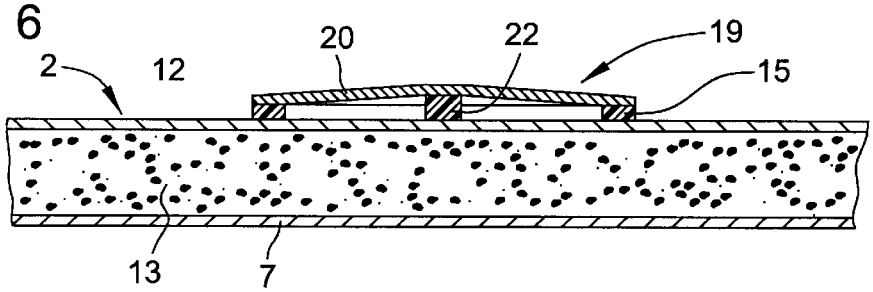
FIGS. 6 and 7 are two views, in cross section, along lines VI—VI and VII—VII of FIG. 5.
Figure 7:
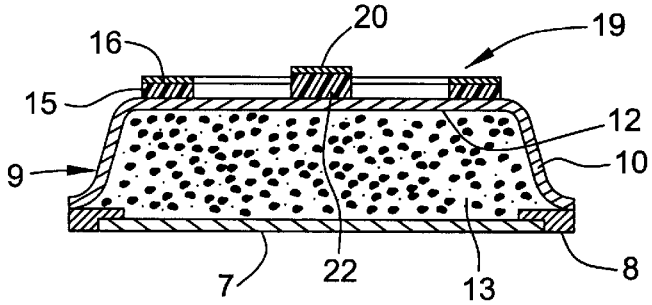

FIGS. 5 to 7 represent another embodiment of this damping device, with a design similar to that of the device in FIGS. 1 to 3. In this case, the device designated by general reference numeral 19 has the general shape of a parallelogram, whose two long sides are in the direction of the length of the board. The two short sides are connected by a lengthwise strip 20 oriented in the direction of the length of the board. This strip 20 is not joined to the ski in its central part, and is predeformed upward as shown in FIGS. 6 and 7 because of the presence on the upper surface of the ski of a stud 22 made of an elastic material, this stud forming a support and ensuring predeformation of strip 20 on the side opposite the ski. This arrangement orients the direction of deformation of the strip, and favors the buckling phenomenon when the ski flexes.

Figure 8:
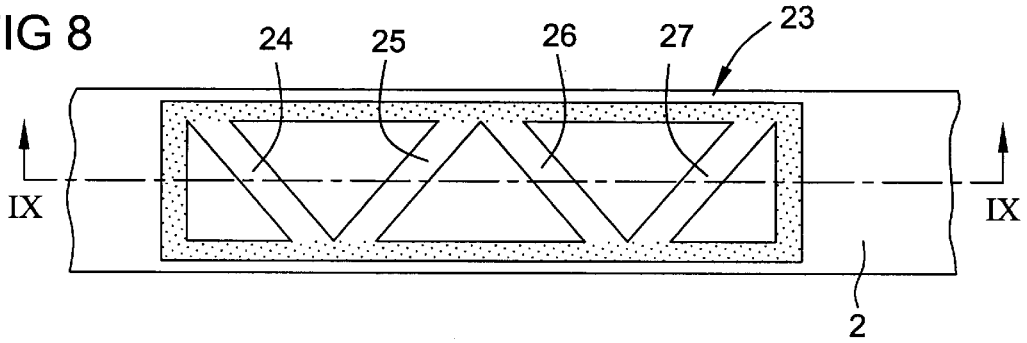
FIG. 8 is a top view of a third embodiment of this damping device.
Figure 9:
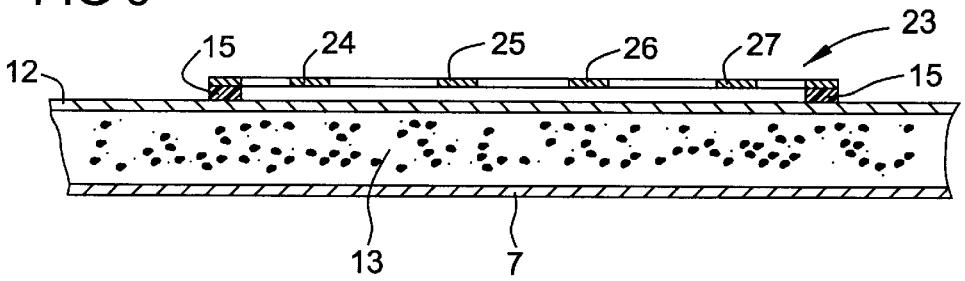
FIG. 9 is a view in lengthwise cross section along line IX—IX in FIG. 8.

FIGS. 8 and 9 show another embodiment of this damping device, in which the same elements are designated by the same reference numerals as before. This device, designated by general reference numeral 23, has the general shape of a rectangle with the central part open. In this central part, four strips 24, 25, 26, 27, inclined at 45° to the lengthwise axis of the board, are disposed between the two long sides. Two of the strips, 24 and 26, are inclined in the reverse direction to that of the two others. By this inclination, each strip possesses a leaf spring effect by buckling, not only when the board is flexed, as in the above cases, but also when the board is deformed by twisting or warping. The angle of 45°, given as an example, could be different, and the strips could be pre-bent to orient the buckling action.

Figure 10:
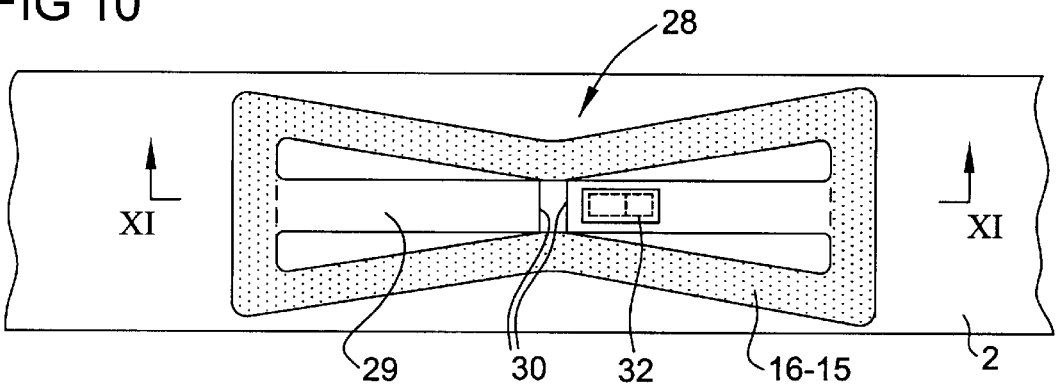
FIG. 10 is a top view of a fourth damping device.
Figure 11:
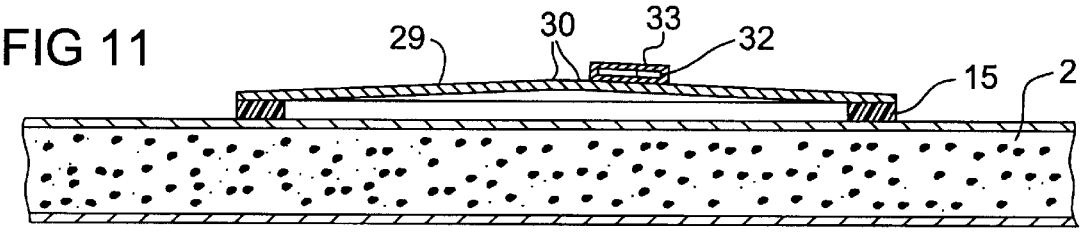
FIG. 11 is a view in lengthwise cross section along line XI—XI in FIG. 10.

FIGS. 10 and 11 show another embodiment of this device in which the same elements are designated by the same reference numerals as above. In this device, designated by general reference numeral 28, the stress plate and the viscoelastic material layer have the general shape of a bow tie. Strip 29, not joined to the ski, is predeformed on the side opposite the ski because of the presence of folds 30 and, in the vicinity of its area remotest from the ski has a cage 32 containing a weight 33 embedded in a pad of viscoelastic material. This assembly forms an inertial mass that also favors damping of certain vibrations.

Figure 12:
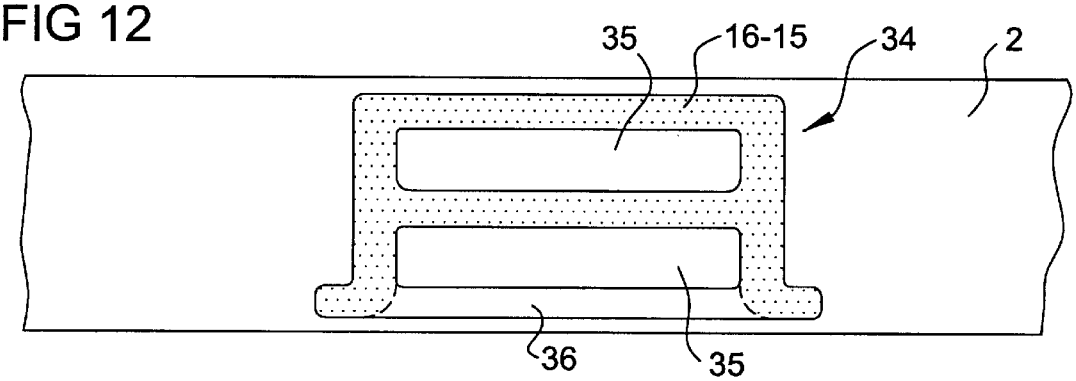
FIGS. 12, 13, and 14 are three top views of three other damping devices.

FIG. 12 shows a damping device 34 with a generally rectangular shape in which two rectangular openings 35, delimiting three parallel branches connected by two end areas perpendicular thereto, are provided in the layer of viscoelastic material and in the stress plate. Of these three branches, one of them disposed laterally forms a strip 36 whose central part is not joined to the ski.

Figure 13:
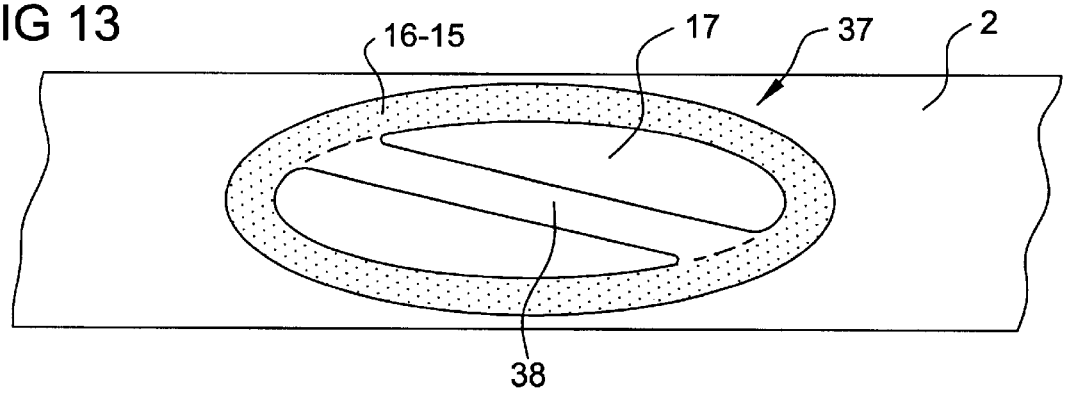

FIG. 13 shows another device, similar to the device in FIG. 2, designated by the general reference numeral 37, in which strip 38, not joined to the ski, is disposed obliquely.

Figure 14:
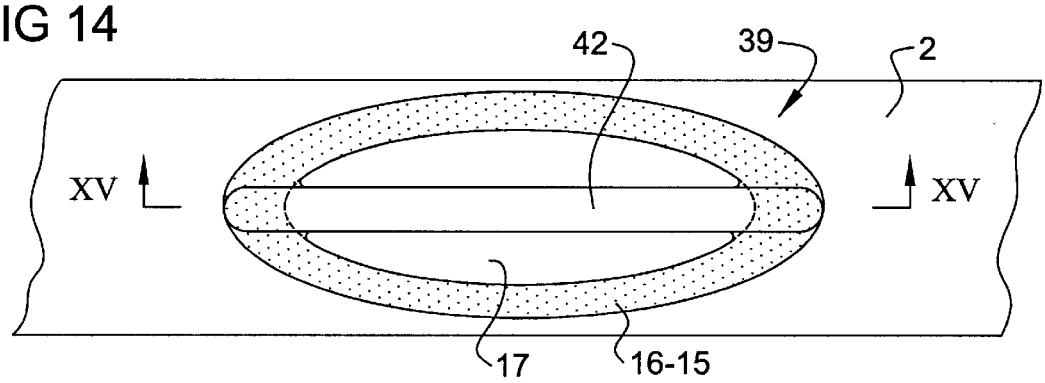
Figure 15:
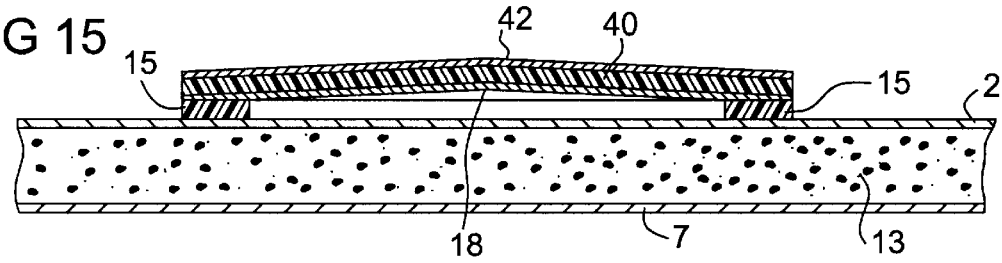
FIG. 15 is a view in lengthwise cross section of the device of FIG. 14 along line XV—XV of this same figure.

FIGS. 14 and 15 show a damping device 39 similar to that of FIGS. 2 and 3, wherein the same elements are designated by the same reference numerals as in these figures. In this case, a layer 40 of viscoelastic material is attached to strip 18, not joined to the ski, and a strip 42 with a high elasticity modulus forming a stress plate is attached to the upper surface of said layer 40. It is thus possible to combine damping properties by both buckling and shearing on the same support.

Figure 16:
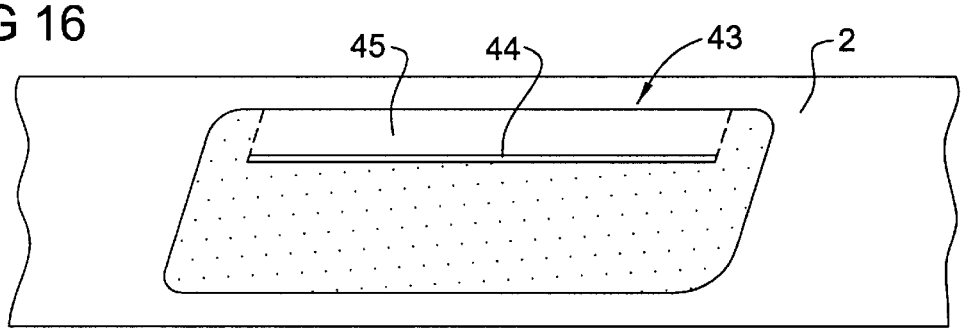
FIGS. 16, 17, and 18 are three top views of three other damping devices.

FIG. 16 shows a damping device 43 which, in a top view, has the shape of a parallelogram. The stress plate, over part of its length, has a lengthwise slit 44. The large surface on one side of slit 44, as well as the areas in front of and to the rear of this slit, over the entire width of the plate, are joined to the ski, while the area located on the other side of the plate, in the upper part of the drawing, forms a strip 45 which is not joined to the ski.

Figure 17:
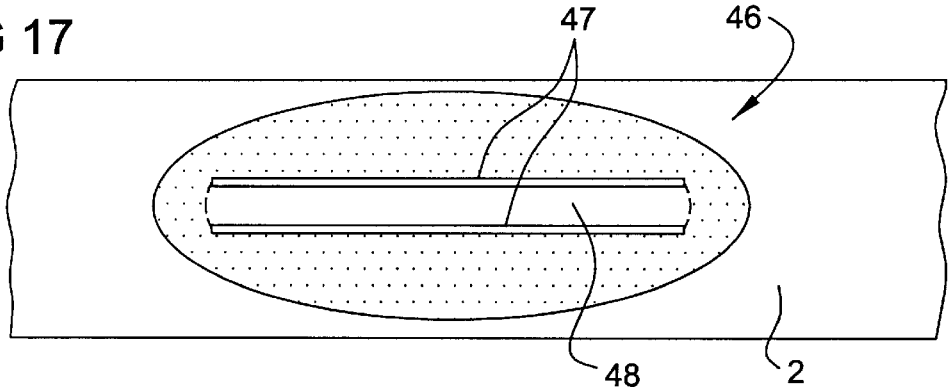

FIG. 17 shows one variant of the device of FIG. 16, this new device 46 being in the general shape of an ellipse, having two slits 47 provided in the stress plate, these slits 47 being central and longitudinal, extending over part of the length of the stress plate and delimiting between them a strip 48 not joined to the upper surface of the ski.

Figure 18:
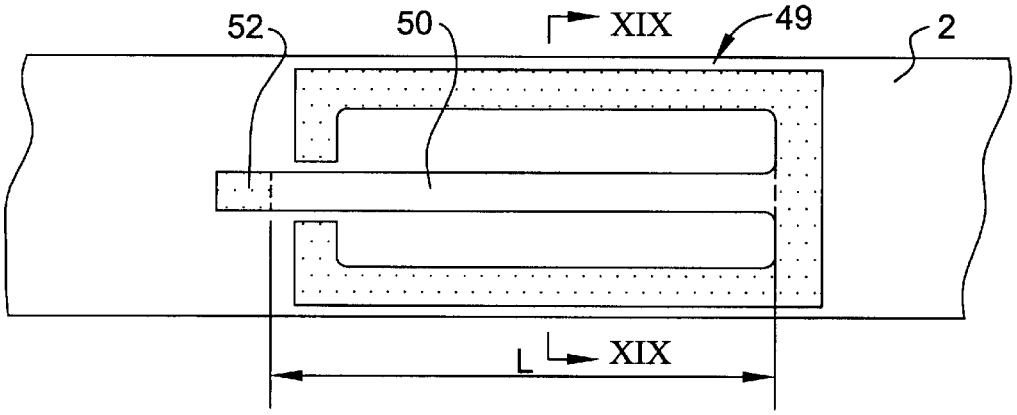
Figure 19:
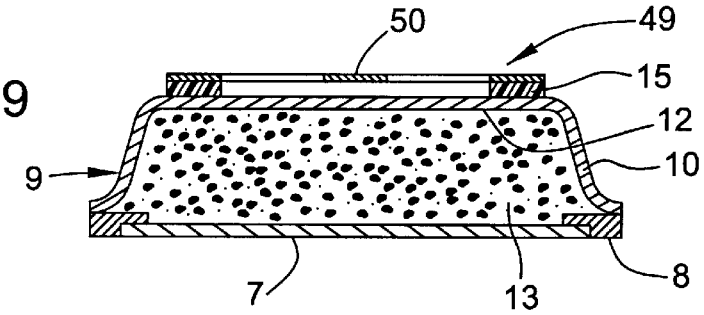
FIG. 19 is a cross-sectional view of the damping device of FIG. 18 along line XIX—XIX of this same figure.

FIGS. 18 and 19 show another embodiment of the damping device, designated by general reference numeral 49. In this embodiment, the stress plate and the viscoelastic material layer associated therewith have the general shape of an open O. Starting from the central area of the O, there extends a strip 50, not joined to the ski in its central part, the free end of which is attached to the ski at 52, independently of the stress plate, through a layer of viscoelastic material. In this way, the length of strip 50, corresponding to its central part not joined to the board, can be far longer than the counterplate proper, which has the consequence of increasing buckling, and hence the spring effect.

Figure 20:
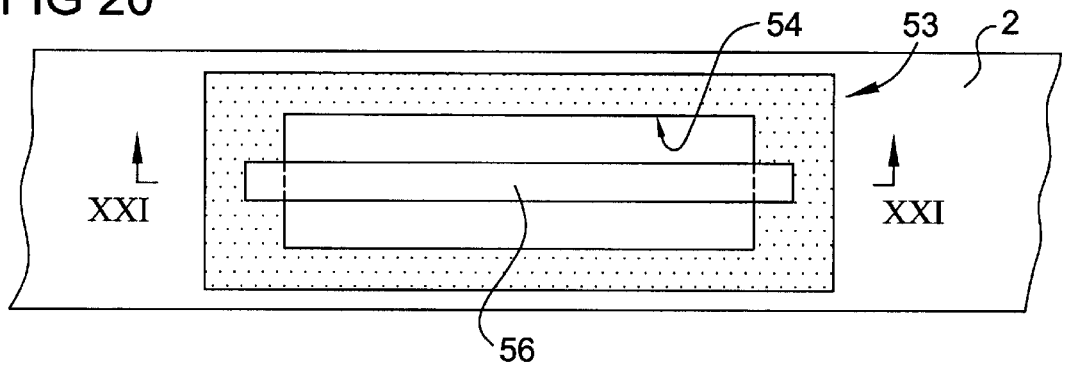
FIG. 20 is a top view of a damping device in which the strip not joined to the ski, is mounted on the stress plate.
Figure 21:
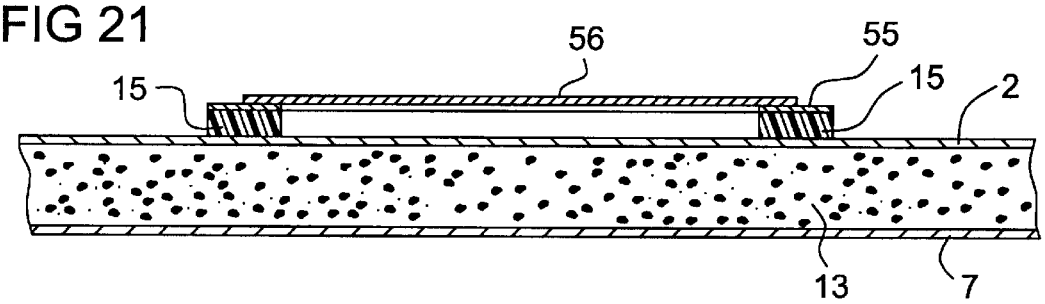
FIG. 21 is a view of this device in lengthwise cross section along line XXI—XXI of FIG. 20.

In the embodiment shown in FIGS. 20 and 21, damping device 53 has a layer of viscoelastic material and a stress plate with a generally rectangular shape having a central opening 54 which is also rectangular. The ends of a strip 56 made of a flexible material are attached, by welding or gluing for example, depending on the nature of the materials employed, to the upper surface of stress plate 55.

Figure 22:
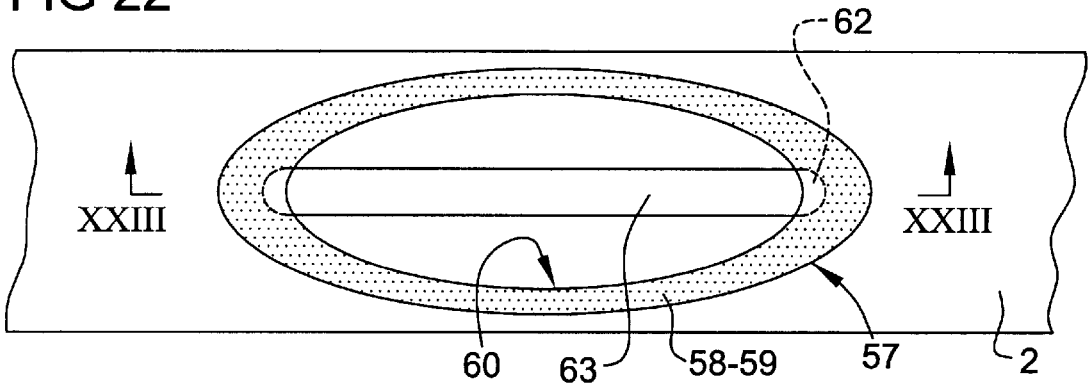
FIG. 22 is a top view of another damping device in which the strip, not joined to the ski, is fitted into the stress plate.
Figure 23:
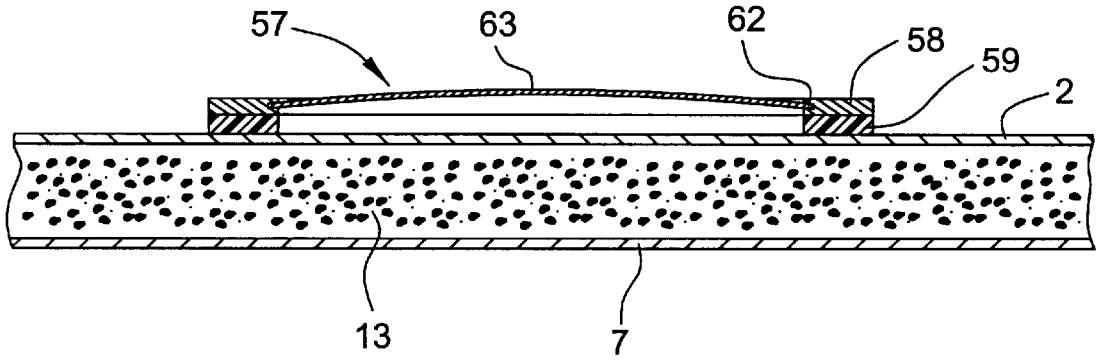
FIG. 23 is a view in lengthwise cross section along line XXIII—XXIII of FIG. 22.

In the embodiment of FIGS. 22 and 23, damping device 57 has a stress plate and a layer of viscoelastic material, which are designated respectively by reference numerals 58 and 59, that have the general shape of an ellipse, with a central opening 60. In the internal surface of plate 58 are recesses 62 designed to receive the ends of an elastic strip 63 which is pre-deformed on the side opposite the ski, with a snug fit.

The latter two embodiments are advantageous because they allow the strip not joined to ski 56, 63 to be made of a material different from that of which the stress plate is made, which affords excellent elastic return properties on the part of the strip not joined to the ski.

It goes without saying that the invention is not confined to the embodiments of this device described hereinabove as examples, but on the contrary, embraces all variants thereof. Thus, in particular, this device could have several strips not joined to the ski or this device could be applied to sliding boards other than a ski, for example a snowboard or monoski, or, depending on the geometry of the sliding board, the damping device could be attached not to the upper surface, substantially parallel to the bottom, but to an inclined surface, or to the side of the board, without thereby departing from the invention.

What is claimed is:

1. A vibration damping device for a board for sliding on snow, comprising:

a layer of viscoelastic material attached to an outer surface of the board;

a stress plate attached to the layer of viscoelastic material, wherein the stress plate has a high modulus of elasticity; and at least one strip-shaped member, each at least one strip-shaped member having end portions and a central portion, the central portion being spaced from the board and free to move with respect to the board upon flexing of the board, at least one of the end portions being connected to the board via the layer of viscoelastic material and at least one of the end portions being connected with the stress plate, and wherein each strip-shaped member is elastically flexible such that when the board flexes, each strip-shaped member behaves like a leaf spring, the stress plate being an integral member that substantially surrounds at least one side and at least one end of the at least one strip-shaped member, the stress plate and the strip-shaped member being spaced apart to define at least one open area on the board formed therebetween.

2. The device according to claim 1, wherein the at least one strip-shaped member is an integral part of the stress plate.

3. The device according to claim 1, wherein the at least one strip-shaped member is distinct from the stress plate, and wherein the end portions of each at least one strip-shaped member are attached to the stress plate.

4. The device according to claim 3, wherein the ends of the at least one strip-shaped member are permanently attached to the stress plate.

5. The device according to claim 3, wherein the end portions of the at least one strip-shaped member are inserted into openings in the stress plate.

6. The device according to claim 1, wherein the layer of viscoelastic material is not located between the central portion of the at least one strip-shaped member and the board.

7. The device according to claim 6, further comprising an elastic stud located between the central portion of the at least one strip-shaped member and the board, wherein the stud has a thickness greater than the distance between the board and the end portions of the at least one strip-shaped member, and wherein the stud deforms the at least one strip-shaped member so that it bulges away from the board.

8. The device according to claim 1, wherein the layer of viscoelastic material is provided between the central portion of the at least one strip-shaped member and the board.

9. The device according to claim 1, wherein the at least one strip-shaped member is preformed by bending to include a bulge on a side of the at least one strip-shaped member opposite the board.

10. The device according to claim 1, further comprising a weight member that is attached to a side of the central portion of the at least one strip-shaped member opposite the board.

11. The device according to claim 10, wherein the weight member comprises a cage containing a weight embedded in a viscoelastic substance.

12. The device according to claim 1, wherein the at least one strip-shaped member is substantially straight.

13. The device according to claim 12, wherein a longitudinal axis of the at least one strip-shaped member is substantially parallel to a longitudinal axis of the board.

14. The device according to claim 12, wherein a longitudinal axis of the at least one strip-shaped member is oriented at an angle with respect to a longitudinal axis of the board.

15. The device according to claim 1, wherein the stress plate comprises two elongated strips having longitudinal axes oriented substantially parallel to a longitudinal axis of the board, wherein the at least one strip-shaped member comprises plural strip-shaped members having longitudinal axes oriented at an angle with respect to the longitudinal axis of the board, and wherein opposite ends of the strip-shaped members are joined to respective ones of the two elongated strips.

16. The device according to claim 1, wherein the stress plate comprises two strips that are joined to the board along their entire lengths, and wherein the at least one strip-shaped member is disposed between the two strips.

17. The device according to claim 16, wherein the end portions of the at least one strip-shaped member and end portions of the two strips comprise integral portions of the stress plate.

18. The device according to claim 16, wherein a first end of the at least one strip-shaped member and first ends of the two strips comprise an integral portion of the stress plate, and wherein a second end of the at least one strip-shaped member and second ends of the two strips are each separately joined to the board.

19. The device according to claim 1, wherein the stress plate comprises two strips that are joined to the board along their entire lengths, and wherein the at least one strip-shaped member is disposed on one side of the two strips.

20. The device according to claim 1, wherein the layer of viscoelastic material comprises a first layer of viscoelastic material, wherein the stress plate comprises a first stress plate, and further comprising:

a second layer of viscoelastic material attached to a surface of the at least one strip-shaped member opposite the board; and a second stress plate attached to a side of the second layer of viscoelastic material opposite the at least one strip-shaped member.

21. A vibration damping device for a board for sliding on snow, comprising:

a layer of viscoelastic material attached to an outer surface of the board;

a stress plate attached to the layer of viscoelastic material, the stress plate having a high modulus of elasticity and comprising at least two strips that are joined to the board along their entire lengths; and at least one strip-shaped member disposed between two of the at least two strips, eachat least one strip-shaped member having end portions and a central portion, the central portion being spaced from the board and free to move with respect to the board upon flexing of the board, at least one of the end portions being connected to the board via the layer of viscoelastic material and at least one of the end portions being connected with the stress plate, a first end of the at least one strip-shaped member and first ends of the two strips comprising an integral portion of the stress plate, a second end of the at least one strip-shaped member and second ends of the two strips being separately joined to the board, wherein each strip-shaped member is elastically flexible such that when the board flexes, each strip-shaped member behaves like a leaf spring.

* * * * *